US005282119A

United States Patent [19]

Feder

[11] Patent Number: 5,282,119

[45] Date of Patent: Jan. 25, 1994

[54] LAMP WITH LIGHT DIFFUSING SIDE BAFFLE

[76] Inventor: Abe H. Feder, 1600 Broadway, Suite 703, New York, N.Y. 10019

[21] Appl. No.: 55,881

[22] Filed: May 4, 1993

[51] Int. Cl.[5] ..... F21V 1/00; F21V 11/02

[52] U.S. Cl. ..... 362/291; 362/351; 362/354

[58] Field of Search ..... 362/290, 291, 292, 354, 362/355, 356, 342, 351

[56] References Cited

U.S. PATENT DOCUMENTS

| | | | |
|---|---|---|---|
| 2,078,032 | 4/1937 | Sibbert | 362/291 |
| 2,308,071 | 1/1943 | Foss et al. | 362/291 |
| 2,369,778 | 2/1945 | Feder | 362/354 |
| 3,784,811 | 1/1974 | Feder | 362/227 |
| 3,878,390 | 4/1975 | Feder | 362/290 |
| 4,063,079 | 12/1977 | Feder | 362/290 |

*Primary Examiner*—Richard R. Cole
*Attorney, Agent, or Firm*—David H. Semmes

[57] ABSTRACT

Electric lamps of the type embodying a lampshade, particularly a combination louvre and baffle which diffuses the electric light through the sides of the lampshade. The louvre is positioned above the electric light fixtures, so as to reflect and diffuse light radiating upwardly and the baffle is positioned at the side of the electric light source so as to diffuse laterally light through the lampshade.

2 Claims, 2 Drawing Sheets

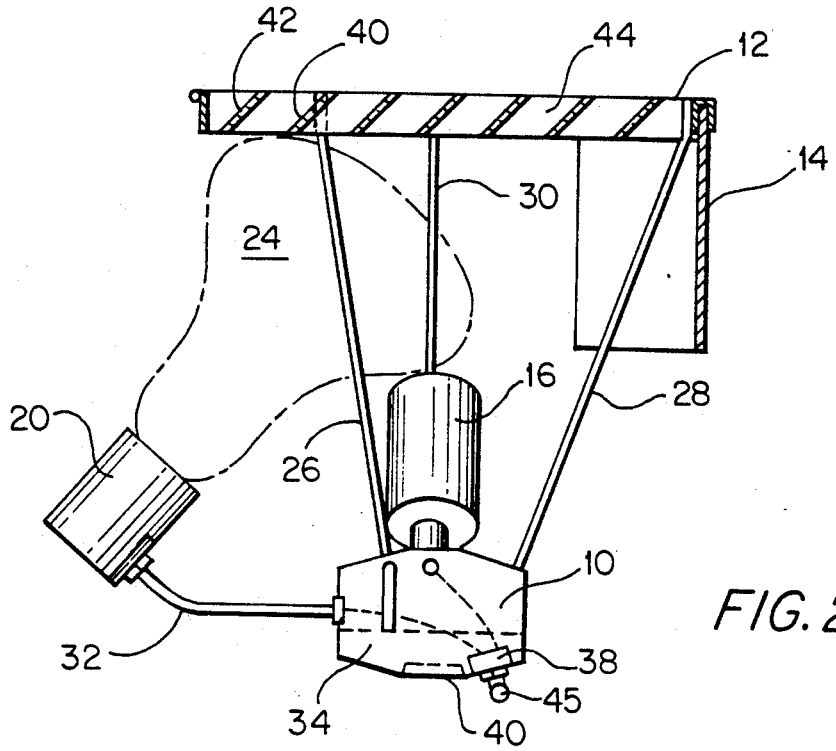
FIG. 2
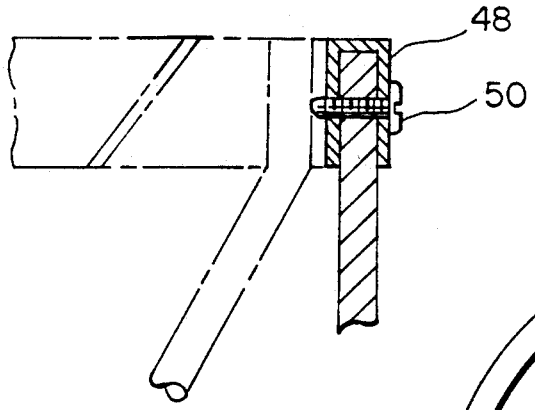
FIG. 5
FIG. 6
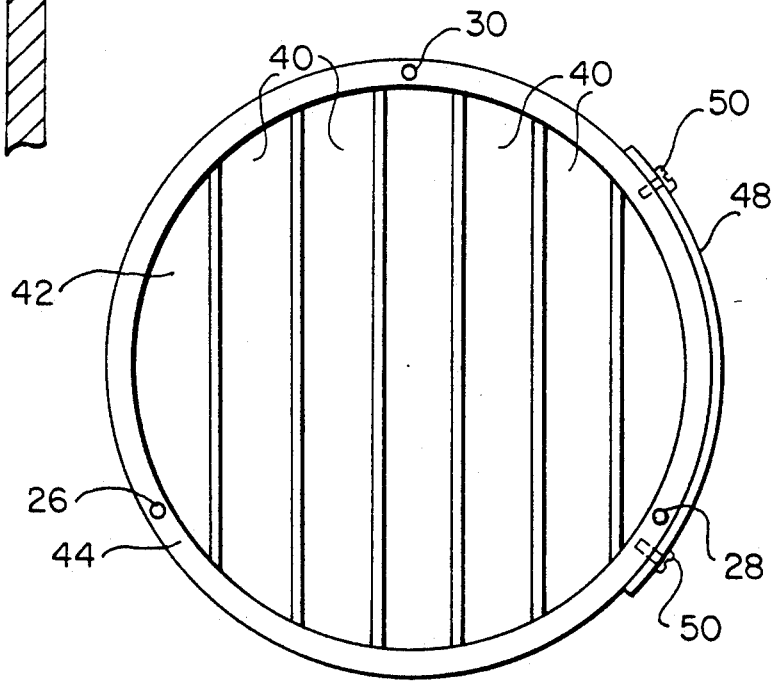

LAMP WITH LIGHT DIFFUSING SIDE BAFFLE

BACKGROUND OF THE INVENTION

1. Field of the Invention

Electric lamps, particularly "combination" lighting fixtures which provide both direct and indirect illumination. Such lighting fixtures are for the most part, used in combination with a light diffusing baffle and a conventional lampshade.

2. Description of the Prior Art

FEDER U.S. Pat. No. 3,878,390
FEDER U.S. Pat. No. 4,063,079
BALDWIN U.S. Pat. No. 4,186,433
HAHLEN U.S. Pat. No. 4,245,283
MORI U.S. Pat. No. 4,536,828
HSIEH U.S. Pat. No. 4,609,978
MOLNAR U.S. Pat. No. 4,799,136

The prior art "combination" light fixtures, embodying a top baffle and an encircling lampshade have directed a "spot glow" of light onto the inner surface of the shade. Such "spot glows" are discernable on the shade exterior and ultimately fade the interior surface of the lampshade. When one views the lamp shade from the exterior, the visual effect is of one or more "spot glows" burning through the sides of the shade.

SUMMARY OF THE INVENTION

According to the present invention, a "combination" lamp with lampshade includes an incandescent bulb fixture with one or more electric light bulb fixtures, and a superposed top louvre which diffuses that light which is radiated upwardly. In addition, a downwardly extending side baffle of frosted glass, or the like is secured to the side of the top louvre. The side baffle laterally diffuses or spills light through the inner surface of the lampshade. Thus, instead of the "spot glow", there is provided a half glow of diffused light on the lampshade interior. This diffused light enhances the decorative aspect of the lighting fixture, while more evenly diffusing light through the lampshade.

DESCRIPTION OF THE DRAWINGS

FIG. 2 is a front elevation, partially in vertical section, showing the support of the side baffle with respect to the top louvre.

FIG. 5 is an enlarged fragmentary vertical section (partially in phantom), showing the arcuate guide affixed to the upper edge of the annular side baffle.

FIG. 6 is a top plan of the baffle.

DESCRIPTION OF THE PREFERRED EMBODIMENTS

Figure 1:
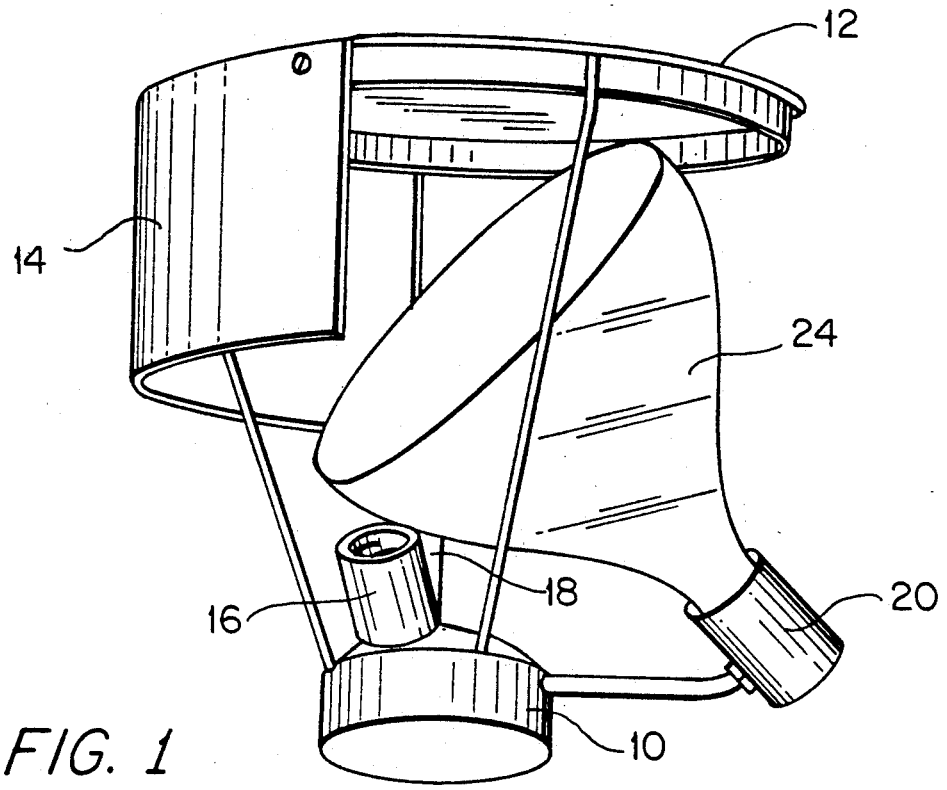
FIG. 1 is a front elevation of a lighting fixture embodying a halogen lamp together with two conventional incandescent lamps, a top louvre and a downwardly extending side baffle.
Figure 3:
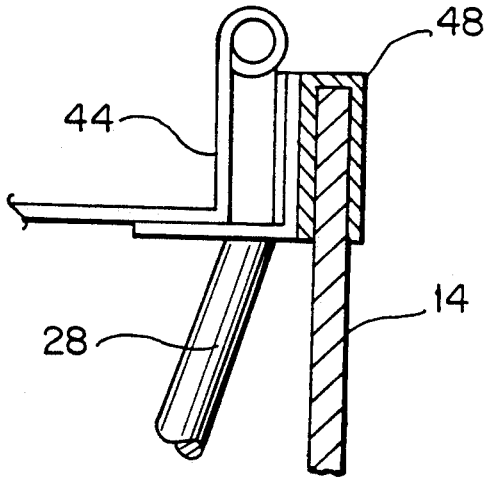
FIG. 3 is an enlarged transverse section through the louvre frame and side baffle, showing securement of the top portion of the side baffle to the louvre frame.

In FIGS. 1 and 2 the lamp is shown as comprising circular base 10 having waist portion 34 which may be fitted upon a conventional vase or lamp by means of peripheral set screws (not shown). Louvre top frame 12 with inner lip or flange 44 is shown with downwardly extending side baffle 14 attached to its periphery. Incandescent lighting socket 16 is secured in base 10 so as to support conventional incandescent bulb (not shown). A halogen bulb socket 20 may be mounted upon hallow strut 32 as a support for halogen lamp 24 of the type manufactured by General Electric Corporation under the designation "HALOGEN-IR (trademark) par 38 lamp, 100 watts, 120 volts".

Halogen lamp 24 is activated by a conventional electrical connection extending from cable 45 through hollow strut 32. Base 10 may include a two-circuit rotary switch 38, interposed between cable 45 and lamp sockets 16, 20.

A plurality of vertically extending struts 26, 28, 30 extend from base 10 to the periphery of louvre frame 12, engaging complementary slots 46. Frame 12 may include a plurality of transverse louvres 42, 40, which may divert upwardly radiated light through the sides of a conventional lampshade.

Figure 4:
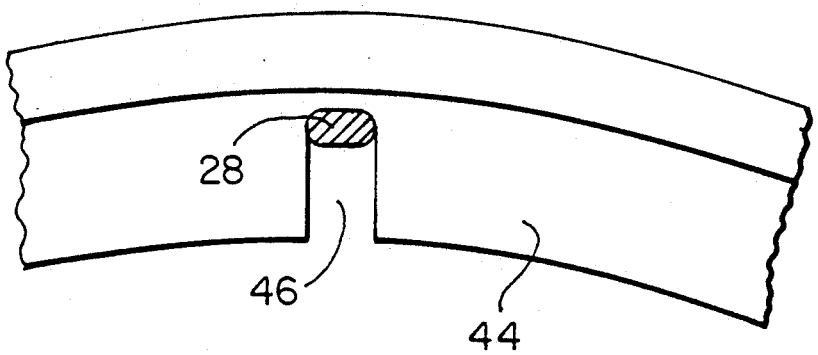
FIG. 4 is an enlarged fragmentary top plan, partially in section, showing a centering of the side baffle on the lamp fixture support rod.

As illustrated in FIG. 5, downwardly extending side baffle 14 may be secured within arcuate support 48 by means of set screw 50 which extends through arcuate support 48, and baffle 14 into louvre frame 12. Side baffle 14 should be centered upon rod 28, as illustrated in FIG. 4. The half-round or arcuate configuration of side baffle 14 literally diffuses reflected light through the lampshade sides and thereby eliminates the conventional "spot glow" radiation of light through the sides of the lampshade.

Manifestly, various types of downwardly extending side baffles may be used and such side baffles may be variously secured to the louvre frame without departing from the spirit of invention.

I claim:

1. A lamp with light diffusing baffle comprising:

a) a base having at least one base socket for support of an electric lighting fixture, together with an electrical connection extending from said socket and outwardly of said base to a power source;

b) at least one electrical lighting fixture supported in said base socket;

c) a baffle supported above said base so as to direct selectively, light radiating upwardly from said electric lighting fixture with respect to said base, said baffle further including:

i) a plurality of support strut members extending upwardly from said base;

ii) a peripheral louvre frame secured to said support members;

iii) a plurality of selectively angled louvres extending transversely across said frame;

iv) an annular side baffle plate secured to the perimeter of said frame and extending downwardly thereof, so as to laterally diffuse light from said electrical lighting fixture, and v) an arcuate guide secured to said peripheral louvre frame so as to encompass an upper edge of said annular side baffle.

2. A lamp with light diffusing baffle as in claim 1, including baffle securement means extending through said arcuate guide and said side baffle plate.

* * * * *